United States Patent [19]

Helinsky

[11] Patent Number: 4,574,822

[45] Date of Patent: Mar. 11, 1986

[54] AMUSEMENT AND TOILETRY DISPENSER FOR BABIES

[76] Inventor: Jonathan Helinsky, 198 Woodward Ave., Staten Island, N.Y. 10314

[21] Appl. No.: 615,465

[22] Filed: May 30, 1984

[51] Int. Cl.[4] ..... A45D 40/00

[52] U.S. Cl. ..... 132/79 R; 206/823; 221/199

[58] Field of Search ..... 132/79 R, 79 F, 79 G, 132/80 R, 1 R; 221/34, 35, 44, 45, 120, 155, 199; 206/823

[56] References Cited

U.S. PATENT DOCUMENTS

| | | | |
|---|---|---|---|
| 1,049,511 | 1/1913 | Mulgrew | 221/35 |
| 1,421,645 | 7/1922 | Wilson | 206/823 |
| 1,443,858 | 1/1923 | Windecker | 132/79 R |
| 2,145,462 | 1/1939 | Speck | 132/79 G |
| 3,967,756 | 7/1976 | Barish | 221/45 |
| 4,024,880 | 5/1977 | Newton et al. | 132/79 F |

*Primary Examiner*—John J. Wilson

*Attorney, Agent, or Firm*—Richard L. Miller

[57] ABSTRACT

An amusement and toiletry dispenser which organizes a wide variety of infant and toddler related sundries while entertaining baby. A diaper dispenser is provided which is adaptable to different sized diapers and provides visual indication of the number of diapers remaining. Storage includes: a tissue dispenser, a bottle rack with roll-top cover and a brush drawer. A towlette container holder is adaptable to different sized towlettes. A wind-up ferris wheel with peripheral lights provides amusement while compartments which revolve on the ferris wheel may be used to store small items or medicine.

12 Claims, 10 Drawing Figures

AMUSEMENT AND TOILETRY DISPENSER FOR BABIES

BACKGROUND OF THE INVENTION

The present invention relates generally to the field of infant and toddler accessories and, more specifically, to toiletry dispensers which are both utilitarian to the parent and amusing to the baby.

At the present state of the art many of baby's needs are typically scattered throughout the nursery. Diapers are usually kept in one pile, tissue somewhere else and moist towlettes in a separate container. Bottles containing powders and lotions are helter skelter. Baby's brush is somewhere in a drawer, along with various sundries such as berets and hair clips. Medicines are similarly scattered. Direct lighting becomes difficult because of the scarcity of free space for a free standing lamp. To make matters even worse, as baby becomes more aware of surroundings baby tries to reach for many objects often tossing and turning while the poor frustrated parent is attempting to apply a fresh diaper. It is almost impossible for one person to both change a diaper and entertain baby at the same time.

SUMMARY OF THE INVENTION

It is, therefore, a primary object of the present invention to provide an amusement and toiletry dispenser which organizes baby's toiletries while providing amusement.

A further object is to provide an amusement and toiletry dispenser which contains a diaper dispenser which dispenses one diaper at a time, indicates the number of diapers left in storage and is adaptable to diapers which are different in length such as infant size and toddler size.

Another further object is to provide an amusement and toiletry dispenser which contains a towlette dispenser which adjusts to different size packages of moist towlettes.

Another further object is to provide an amusement and toiletry dispenser which contains a high intensity lamp.

Another further object is to provide an amusement and toiletry dispenser which contains a tissue dispenser.

A still further object is to provide an amusement and toiletry dispenser which contains a bottle rack with cover for powder and lotions.

A still further object is to provide an amusement and toiletry dispenser which contains a brush drawer.

A yet further object is to provide an amusement and toiletry dispenser which contains a wind up ferris wheel with peripheral lights powered by self-contained batteries located in the hub of the ferris wheel. Lined compartments which may be used to store medicines revolve with the ferris wheel.

Another yet further object is to provide an amusement and toiletry dispenser which is truly amusing to baby. This is accomplished with bright colors, a three dimensional clown located next to the brush drawer and a lively lit up moving ferris wheel.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
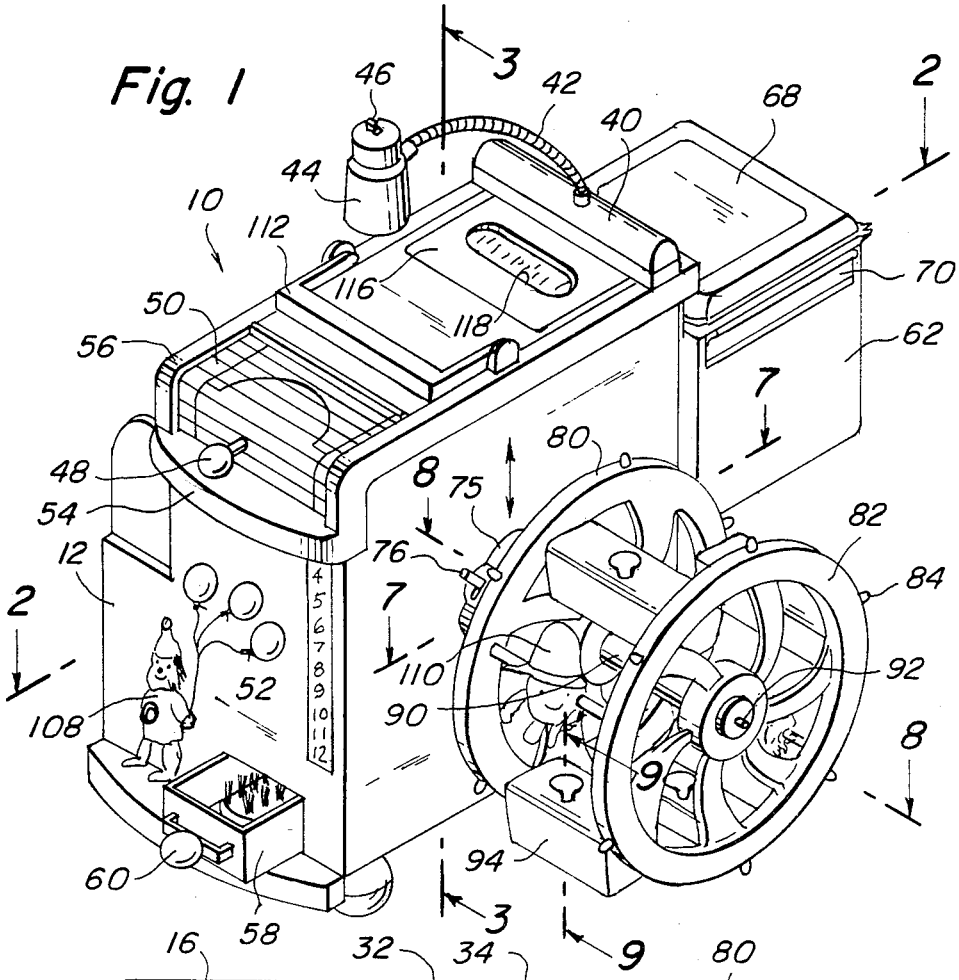
FIG. 1 is a front perspective view of the invention.
Figure 2:
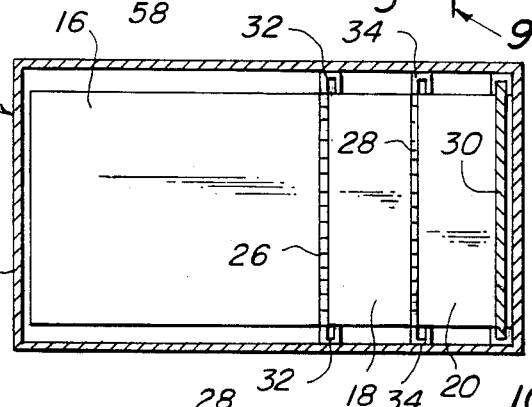
FIG. 2 is a simplified cross sectional view taken along line 2—2 in FIG. 1.
Figure 8:
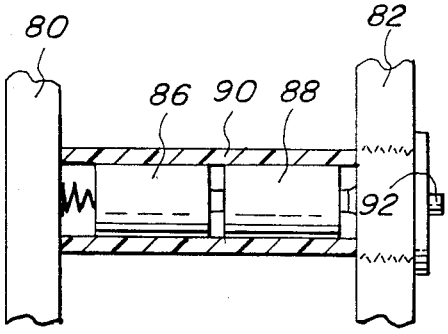
FIG. 8 is a partial cross sectional view taken along line 8—8 in FIG. 1.
Figure 3:
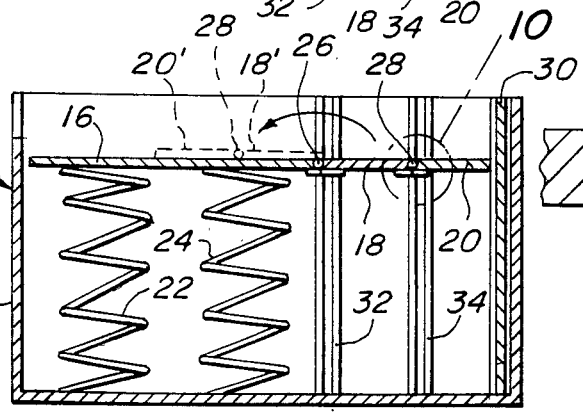
FIG. 3 is a simplified cross sectional view taken along line 3—3 in FIG. 1.
Figure 10:
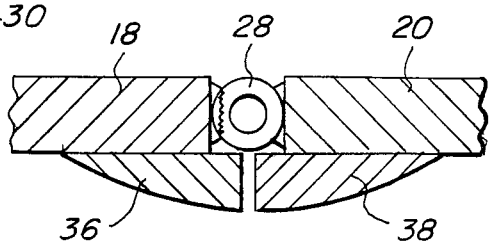
FIG. 10 is an enlarged cross sectional view of the hinge mechanism enclosed in circle 10 in FIG. 3.
Figure 9:
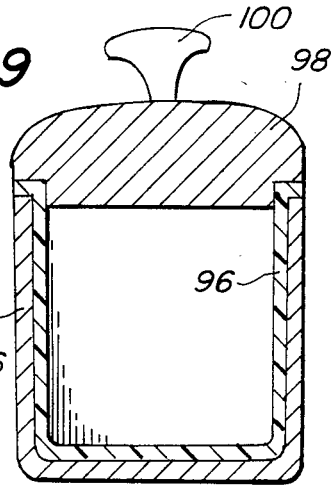
FIG. 9 is a partial cross sectional view taken along line 9—9 in FIG. 1.
Figure 4:
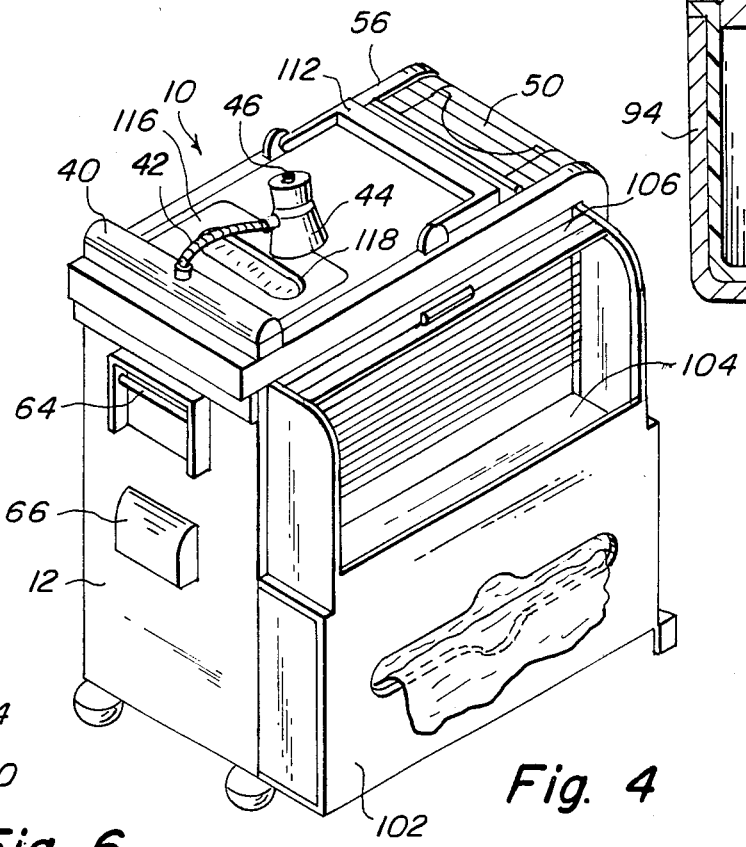
FIG. 4 is a rear perspective view with parts removed.

The main construction of the invention 10 may best be understood with reference to FIGS. 1 and 4. The invention 10 is built around main housing 12 which contains the diaper dispenser 14 illustrated in FIGS. 2 and 3. Diapers rest on diaper platform 16 and diaper platform extensions 18 and 20 all of which are biased upward by coiled springs 22 and 24. Diapers come in a standard width but varying lengths. If short diapers are used diaper platform extension 18 and 20 may be folded into positions 18' and 20' shown in phantom by folding diaper platform extensions 18 and 20 at hinges 26 and 28 respectively. In order to prevent the short diapers from shifting around or falling off diaper platform 16 completely, a movable end stop plate 30, shown in storage position, may be moved to end stop plate track 32 or 34. The details of hinge 28 may best be understood with reference to FIG. 10. Note that one way stops 36 and 38 add rigidity to the entire diaper platform and prevent diaper platform extensions 18 and 20 from buckling downwards. When a diaper is desired, an upward motion of handle 48 rolls up roll-top diaper dispenser cover 50 and a diaper may be removed. The number of diapers remaining may easily be determined by observing diaper level indicator 52. When the diaper supply is exhausted new diapers may be loaded by pulling upward on handle 54 which causes diaper dispenser lid 56 to hinge open.

A lamp is provided with power supplied by batteries contained in battery holder 40 transmitted via wires contained in goose neck extension 42 to a lamp contained in lamp hood 44. An on-off switch 46 is provided.

A brush drawer 58 with associated handle 60 is provided.

Figure 6:
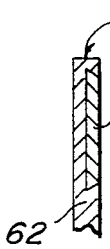
FIG. 6 is a partial cross sectional view taken along line 6—6 in FIG. 5.
Figure 5:
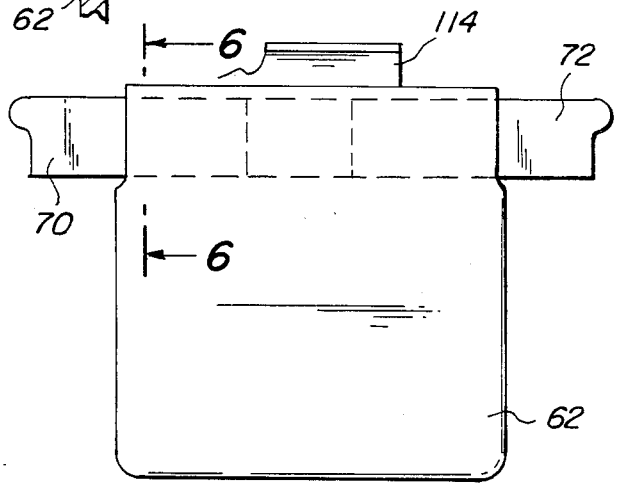
FIG. 5 is a side view of the adjustable container.
Figure 7:
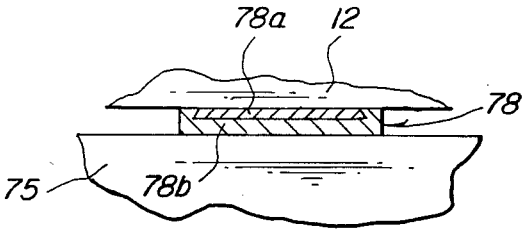
FIG. 7 is a partial cross sectional view taken along line 7—7 in FIG. 1.

A towlette dispenser 62 fits onto main body 12 by utilizing link pin 64 which engages a mating flange 114 on towlette dispenser 62. A rest stop 66 limits the downward rotational movement of towlette dispenser 62. A typical towlette container 68 is shown installed into towlette dispenser 62. Since towlette containers come in varying widths sliding extension support arms 70 and 72 as shown in FIG. 5. The sliding structure is shown in FIG. 6 where sliding dovetail joint 74 is shown.

The ferris wheel structure is best understood with reference to FIGS. 1, 7, 8 and 9. The power source for rotation of the ferris wheel is a wind up motor enclosed in motor housing 75 which is controlled by on-off lever 76. The attachment of ferris wheel wind up motor housing 75 to main housing 12 is accomplished by sliding dovetail joint 78 with male member 78*a* and female member 78*b*. The periphery of ferris wheel rims 80 and 82 are studded with lamps typified by 84 whose power source is a pair of batteries 86 and 88 located inside hub 90 as shown best in FIG. 8. A press on- press off push-button switch 92 is located in the center of hub 90. Four compartments typified by 94 hang from the ferris wheel. A detailed cross sectional view of compartment 94 may be seen in FIG. 9. The inside of compartment 94 is lined with an easily removed and easily cleaned liner 96. Compartment 94 is provided with a compartment cover 98 and an associated handle 100.

A tissue dispenser 102 and a bottle rack 104 with associated roll-top bottle rack cover 106 are best shown in FIG. 4. Decorative clown toys 108 and 110 are provided for amusement. A sturdy carrying handle 112 is used to transport the invention 10.

An additional compartment 116 which has an observer opening 118 is provided for storing medical records, prescriptions, various other papers, of a similar nature.

While certain novel features of this invention have been shown and described and are pointed out in the annexed claims, it will be understood that various omissions, substitutions and changes in the forms and details of the device illustrates and in its operation can be made by those skilled in the art without departing from the spirit of the invention.

What is claimed is:

1. An amusement and toiletry dispenser, comprising in combination:

(a) a main housing rectangular parallelepiped in shape with integral diaper dispenser;

(b) an amusement type ferris wheel which is attached to one of the side panels of said main housing;

(c) a towlette dispenser which is attached to an end panel of said main housing;

(d) a tissue dispenser and associated bottle rack with roll-top bottle rack cover which are jointly attached to the side panel of said main housing opposite to said amusement type ferris wheel; and, e) a lamp mounted to the top panel of said main housing.

2. An amusement and toiletry dispenser, as recited in claim 1, wherein said integral diaper dispenser comprises a spring biased diaper platform which maintain an upward force on said diapers regardless of the number of diapers stored therein; a diaper level indicator comprising a transparent window with numbers indicating the number of diapers left in storage; a hinged diaper dispenser lid which permits the insertion of a multiplicity of diapers; a roll-top diaper dispenser cover with associated handle which permits the removal of one diaper at a time; and, means for adjusting said diaper dispenser to accommodate diapers of varying length.

3. An amusement and toiletry dispenser, as recited in claim 2, wherein said means for adjusting said diaper dispenser to accommodate diapers of varying length comprises a spring biased diaper platform with two hinged diaper platform extensions which may be hinged upwards to fold said hinged diaper platform extensions flat and thereby not interfere with diaper platform functioning; and a moveable end stop plate with end stop plate tracks located adjacent to said hinges of said diaper platform extensions; whereby, if the use of a short length diaper is required both of said diaper platform extensions may be folded flat and out of the way and said movable end stop plate may be removed from its normal storage position and placed into the appropriate end stop plate track thereby creating a shortened biased diaper platform and container.

4. An amusement and toiletry dispenser, as recited in claim 3, wherein said hinges have one way stops which provide a rigid diaper platform when diaper platform extensions are fully extended but permit said platform extensions to hinge upwards freely.

5. An amusement and toiletry dispenser, as recited in claim 1, wherein said amusement type ferris wheel which is attached to one of the side panels of said main housing comprises a wind up motor fixed into a motor housing and an associated on-off lever; a ferris wheel with lights placed along the outer periphery of the rims of said ferris wheel; a central hub which contains a battery powered voltage source for said lights together with a light on-off switch; a multiplicity of self uprighting hinged compartments complete with inner liner, compartment cover and handle; amusing decorations; and, means for attaching said ferris wheel to one of the side panels of said main housing.

6. An amusement and toiletry dispenser, as recited in claim 5, wherein said means for attaching said ferris wheel to one of the side panels of said main housing comprises a sliding dovetail joint.

7. An amusement and toiletry dispenser, as recited in claim 1, wherein said towlette dispenser which is attached to an end panel of said main housing comprises a towlette dispenser housing; means for attaching said towlette dispenser housing to an end panel of said main housing; and, means for adjusting the width of said towlette housing in order to accept towlette boxes of varying widths.

8. An amusement and toiletry dispenser, as recited in claim 7, wherein said means for attaching said towlette dispenser housing to an end panel of said main housing comprises a link pin integral to said end panel and a mating flange on said towlette dispenser; and, a rest stop which limits the downward rotation of said towlette dispenser when said towlette dispenser is installed to said end panel.

9. An amusement and toiletry dispenser, as recited in claim 7, wherein said means for adjusting the width of said towlette housing in order to accept towlette boxes of varying widths comprises two extension support arms which extend outward from said towlette dispenser and are guided in said extension by a sliding dovetail joint.

10. An amusement and toiletry dispenser, as recited in claim 1, wherein said lamp mounted to the top panel of said main housing comprises a battery case which contains lamp batteries; a goose neck extension which connects said battery case to a lamp hood and an associated on-off switch mounted to said lamp hood.

11. An amusement and toiletry dispenser, as recited in claim 1, further comprising a brush drawer with associated handle wherein said brush drawer is inserted into said main housing below said diaper platform.

12. An amusement and toiletry dispenser, as recited in claim 1, further comprising a hinged carrying handle which may be used to transport the invention from place to place.

* * * * *